US008578956B2

(12) United States Patent
Dankenbring

(10) Patent No.: US 8,578,956 B2
(45) Date of Patent: Nov. 12, 2013

(54) ROOF SUPPORT ASSEMBLY FOR COLLAPSIBLE SHELTER

(76) Inventor: Jeffrey D. Dankenbring, Marysville, KS (US)

( * ) Notice: Subject to any disclaimer, the term of this patent is extended or adjusted under 35 U.S.C. 154(b) by 145 days.

(21) Appl. No.: 13/015,294

(22) Filed: Jan. 27, 2011

(65) Prior Publication Data

US 2012/0192906 A1 Aug. 2, 2012

(51) Int. Cl.
*E04H 15/26* (2006.01)
*E04H 15/48* (2006.01)

(52) U.S. Cl.
USPC ..... 135/99; 135/114; 135/152; 135/147; 135/905; 248/354.7; 403/374.5

(58) Field of Classification Search
USPC ..... 135/98–99, 121, 135, 147, 151–152, 135/114, 119, 905; 248/354.5–354.7; 403/331, 377, 374.5; 174/164
See application file for complete search history.

(56) References Cited

U.S. PATENT DOCUMENTS

| | | | | | |
|---|---|---|---|---|---|
| 1,109,513 | A | | 9/1914 | Cooke | |
| 1,691,411 | A | | 11/1928 | Roth et al. | |
| 1,858,960 | A | * | 5/1932 | Kruger | 135/37 |
| 2,001,196 | A | * | 5/1935 | Jost | 135/98 |
| 2,059,463 | A | * | 11/1936 | Kemp | 135/98 |
| 2,705,119 | A | | 3/1955 | Ingwer | |
| 2,864,389 | A | * | 12/1958 | Smith et al. | 135/98 |
| 3,425,428 | A | * | 2/1969 | Schwartz | 135/114 |
| 3,766,932 | A | * | 10/1973 | Sidis et al. | 135/147 |
| 3,810,482 | A | | 5/1974 | Beavers | |
| 3,851,601 | A | * | 12/1974 | Davis | 108/158.11 |
| 4,111,408 | A | * | 9/1978 | Love | 269/289 R |
| 4,596,405 | A | | 6/1986 | Jones | |
| 4,676,021 | A | | 6/1987 | Groba | |
| 4,819,680 | A | | 4/1989 | Beavers | |
| 5,036,874 | A | * | 8/1991 | Lynch | 135/99 |
| 5,234,011 | A | * | 8/1993 | Lynch | 135/99 |
| 5,345,706 | A | | 9/1994 | Brown | |
| 5,593,239 | A | | 1/1997 | Sallee | |
| 5,628,338 | A | | 5/1997 | Stumbo | |
| 6,286,530 | B1 | * | 9/2001 | Hussey | 135/98 |
| 6,345,639 | B2 | * | 2/2002 | Rousselle et al. | 135/128 |
| 6,523,558 | B1 | * | 2/2003 | Gillis | 135/87 |

(Continued)

OTHER PUBLICATIONS

Cabela's Stoney Point 3-Piece Expedition Monopod, www.cabelas.com, 2010.

(Continued)

*Primary Examiner* — Winnie Yip
(74) *Attorney, Agent, or Firm* — Jeffrey L. Thompson; Thompson & Thompson, P.A.

(57) ABSTRACT

A supplemental support assembly is provided for supporting a collapsible shelter structure, such as a ground blind for hunting. The support assembly includes a pole having a coupler at one end for coupling with a framework of the shelter structure, and a ground engaging point at the other end. The coupler has a generally cylindrical structure with a plurality of slots formed in a sidewall thereof. Each of the slots have an axial portion open at the top and a circumferential portion extending circumferentially from the axial portion. The axial portions of the slots are arranged to allow the coupler to be pushed over a central hub with spokes of the framework passing through the slots, and the circumferential portions of the slots are arranged to allow the coupler to be rotated into locking engagement with the spokes. The support assembly prevents the shelter structure from collapsing under heavy loads.

16 Claims, 4 Drawing Sheets

(56) References Cited

U.S. PATENT DOCUMENTS

| | | | | |
|---|---|---|---|---|
| 6,691,983 | B2 * | 2/2004 | Arzouman | 254/1 |
| 6,733,145 | B2 * | 5/2004 | Shirilla | 362/16 |
| 6,938,927 | B1 | 9/2005 | Martin et al. | |
| 7,344,320 | B2 | 3/2008 | Barker et al. | |
| 7,353,833 | B1 * | 4/2008 | Palmer | 135/118 |
| 7,802,582 | B2 * | 9/2010 | Livacich et al. | 135/147 |

OTHER PUBLICATIONS

Ameristep "Ground Blind Gear Stick," http://ameristep.comiaccessories/1816_stick.html, 2010.

* cited by examiner

ROOF SUPPORT ASSEMBLY FOR COLLAPSIBLE SHELTER

BACKGROUND OF THE INVENTION

1. Field of the Invention

The present invention relates generally to temporary shelter structures, such as tents and hunting blinds. In particular, the present invention relates to methods and devices for supporting collapsible shelter structures.

2. Description of the Related Art

Collapsible shelter structures used for hunting blinds, fishing huts, and the like, are known in the prior art. U.S. Pat. No. 3,810,482 issued to Beavers and U.S. Pat. No. 5,628,338 issued to Stumbo disclose examples of such collapsible shelter structures. These collapsible shelter structures typically include a flexible fabric cover having a plurality of side walls and a top, and a collapsible framework for supporting the flexible fabric cover. The collapsible framework includes, among other things, a central hub and a plurality of resilient spokes for engaging and supporting the top of the fabric cover to provide a free span roof for the shelter structure. There are typically four spokes that are hingedly connected to and radiate outwardly from the central hub to support the roof of the collapsible shelter structure.

The collapsible shelter structures of the type generally shown in the Beavers and Stumbo patents have become popular because, among other things, they are lightweight, portable, and easy to erect, making them useful and desirable for hunters, fishermen, and other outdoor enthusiasts. The collapsible framework used to support the roof in these structures provides a relatively roomy interior free of obstructions. However, the collapsible framework often lacks the strength necessary to withstand the range of external loads imparted to the shelter structure during inclement weather, such as high winds and heavy rain or snow. As a result, these shelter structures often collapse, particularly if they are left in the field for extended periods and/or during inclement weather.

There is a need in the industry for an improved method and device to prevent collapsible shelter structures, such as ground blinds for hunting, from collapsing when they are left in the field.

SUMMARY OF THE INVENTION

It is an object of the present invention to provide a supplemental support assembly that can be used to prevent a collapsible shelter structure from collapsing during inclement weather and to increase the ability of a shelter structure to withstand other external forces without collapsing.

Further objects of the present invention are to provide a support assembly that is lightweight, portable, adjustable, easy to couple with and uncouple from existing shelter structures, reliable in operation, inexpensive to manufacture, and capable of a long operating life.

To accomplish these and other objects of the present invention, a supplemental support assembly is provided for supporting a collapsible shelter structure, such as a ground blind for hunting or a portable shelter for ice fishing. The support assembly includes a pole having a coupler at one end for coupling with a framework of the shelter structure, and a ground engaging point at the other end. The coupler has a generally cylindrical structure with a plurality of slots formed in a sidewall thereof. Each of the slots have an axial portion open at the top and a circumferential portion extending circumferentially from the axial portion. The axial portions of the slots are arranged to allow the coupler to be pushed over a central hub with spokes of the framework passing through the slots, and the circumferential portions of the slots are arranged to allow the coupler to be rotated into locking engagement with the spokes. The support assembly prevents the shelter structure from collapsing under heavy external loads, such as high winds, rain or heavy snow.

According to one aspect of the present invention, a collapsible shelter structure is provided, comprising: a flexible fabric cover having a plurality of side walls and a top; a framework comprising a central hub and a plurality of spokes connected to the central hub and radiating outwardly therefrom for engaging and supporting the top of the fabric cover; and a supplemental support assembly for supporting the framework. The supplemental support assembly comprises a pole having a coupler at one end for coupling with the framework, and a ground engaging structure at the other end of the pole for engaging the ground. The supplemental support assembly supports a center portion of the framework to prevent the shelter structure from collapsing under heavy external loads.

According to another aspect of the present invention, a supplemental support assembly is provided for supporting a collapsible shelter structure. The support assembly comprises: a pole having first and second ends; a coupler connected to the first end of the pole for coupling with a framework of a collapsible shelter structure; and a ground engagement structure provided at the second end of the pole. The coupler comprises a generally cylindrical structure with a plurality of slots formed in a sidewall thereof, each of the slots having an axial portion open at one end of the coupler and a circumferential portion that extends circumferentially from the axial portion. The axial portions of the slots are arranged to allow the coupler to be pushed over a central hub with spokes passing through the slots, and the circumferential portions of the slots are arranged to allow the coupler to be rotated into locking engagement with the spokes.

According to another aspect of the present invention, a method of providing supplemental support for a collapsible shelter structure is provided, comprising: providing a supplemental support assembly having a pole with first and second ends, a coupler at the first end, and a ground engaging structure at the second end; coupling the coupler with a center portion of a framework supporting a top of the collapsible shelter structure; and placing the ground engaging structure into engagement with the ground surface under the center portion.

Numerous other objects and features of the present invention will be apparent to those skilled in this art from the following description wherein there is shown and described embodiments of the present invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

A supplemental support assembly 10 for supporting a collapsible shelter structure 11 according to the present invention will now be described in detail with reference to FIGS. 1 to 9 of the accompanying drawings.

Figure 8:
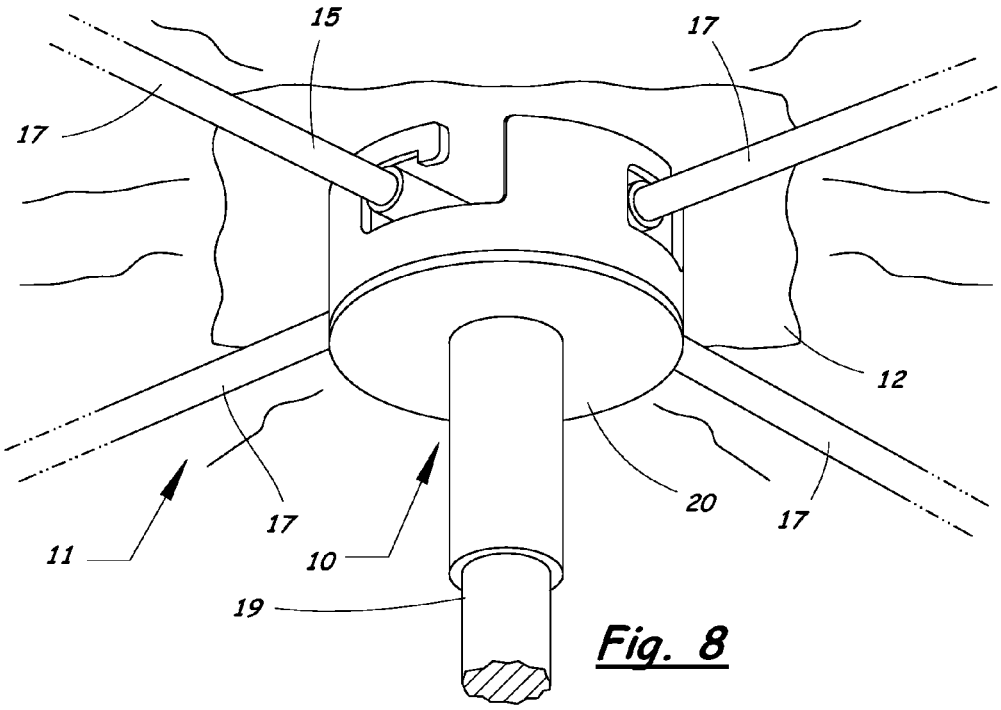
FIG. 8 is a perspective view of the support assembly of the present invention coupled with the central hub and spokes of a collapsible shelter structure.
Figure 9:
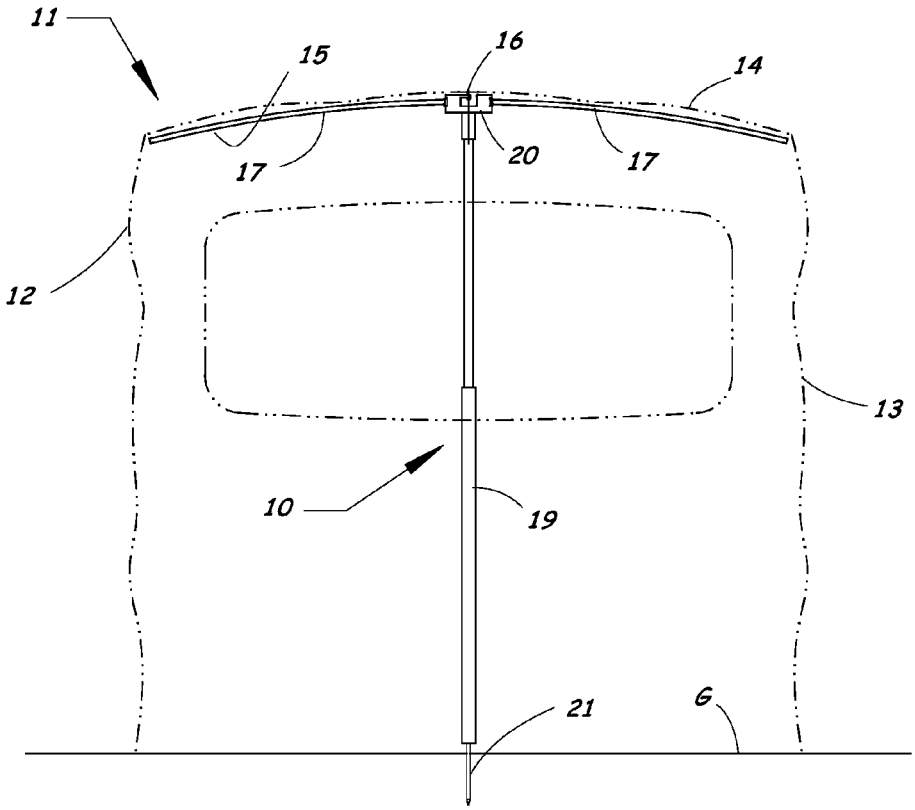
FIG. 9 is an elevation view of the support assembly of the present invention coupled with the central hub and spokes of a collapsible shelter structure.

The supplemental support assembly 10 of the present invention is used in combination with a collapsible shelter structure 11. As shown in FIGS. 8 and 9, the collapsible shelter structure 11 includes a flexible fabric cover 12 having a plurality of side walls 13 and a top 14, and a collapsible framework 15 for supporting the flexible fabric cover 12. The collapsible framework 15 includes, among other things, a central hub 16 and a plurality of resilient spokes 17 for engaging and supporting the top of the fabric cover 12 to provide a clear span roof for the shelter structure 11. The spokes 17 are hingedly connected to the central hub 16 and radiate outwardly therefrom. In the illustrated embodiment, there are four spokes 17 that radiate outwardly from the central hub 16. The four spokes 17 are supported at their outer ends by a primary support assembly (not shown) that also defines the side walls 13 of the shelter structure 11.

The supplemental support assembly 10 is used to provide a temporary support for supporting the center of the roof of the shelter structure 11. The supplemental support assembly 10 is designed to be easily coupled with and uncoupled from a center portion of the framework 15 supporting the roof. The support assembly 10 includes a pole 19 having a coupler 20 at a first top end and a ground engaging structure 21 at a second bottom end.

Figure 1:
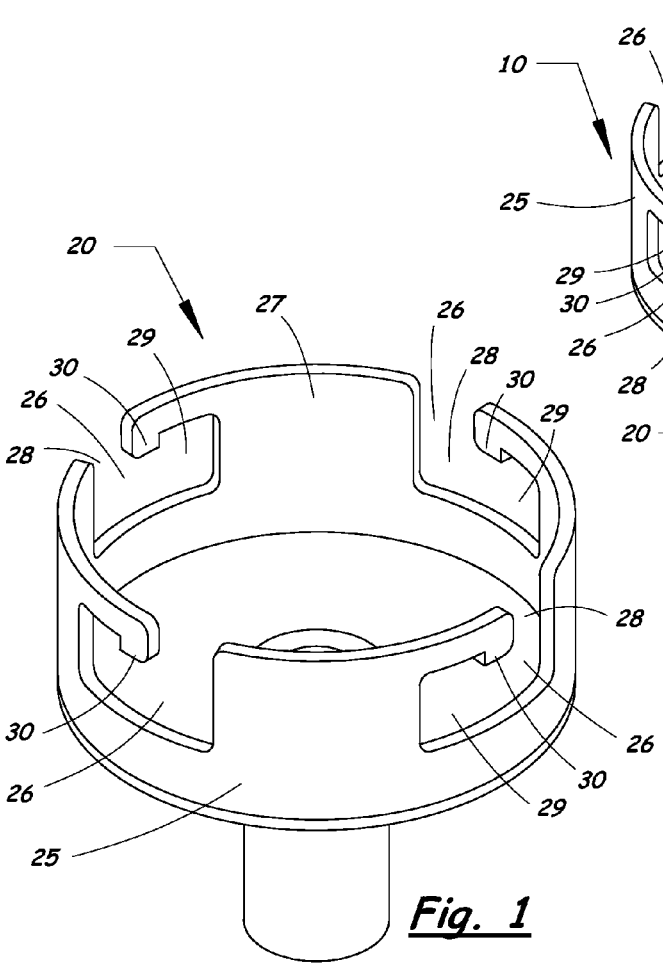
FIG. 1 is a perspective view of a coupler for a supplemental support assembly according to the present invention.
Figure 2:
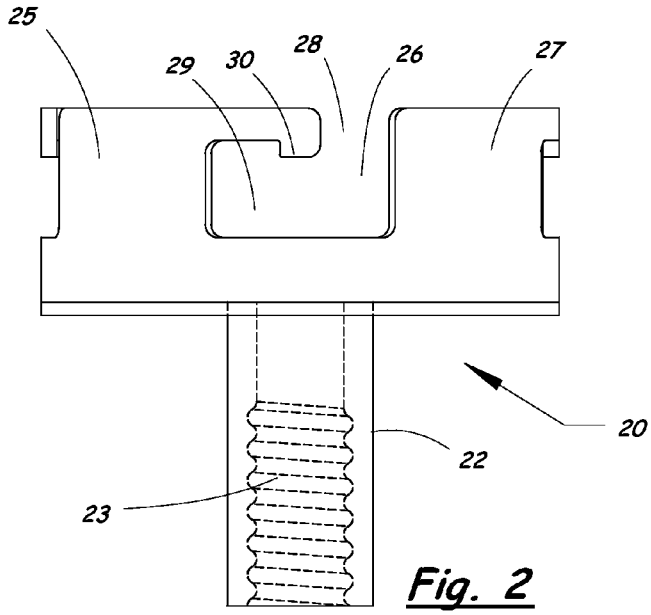
FIG. 2 is an elevation view of the coupler shown in FIG. 1.
Figure 3:
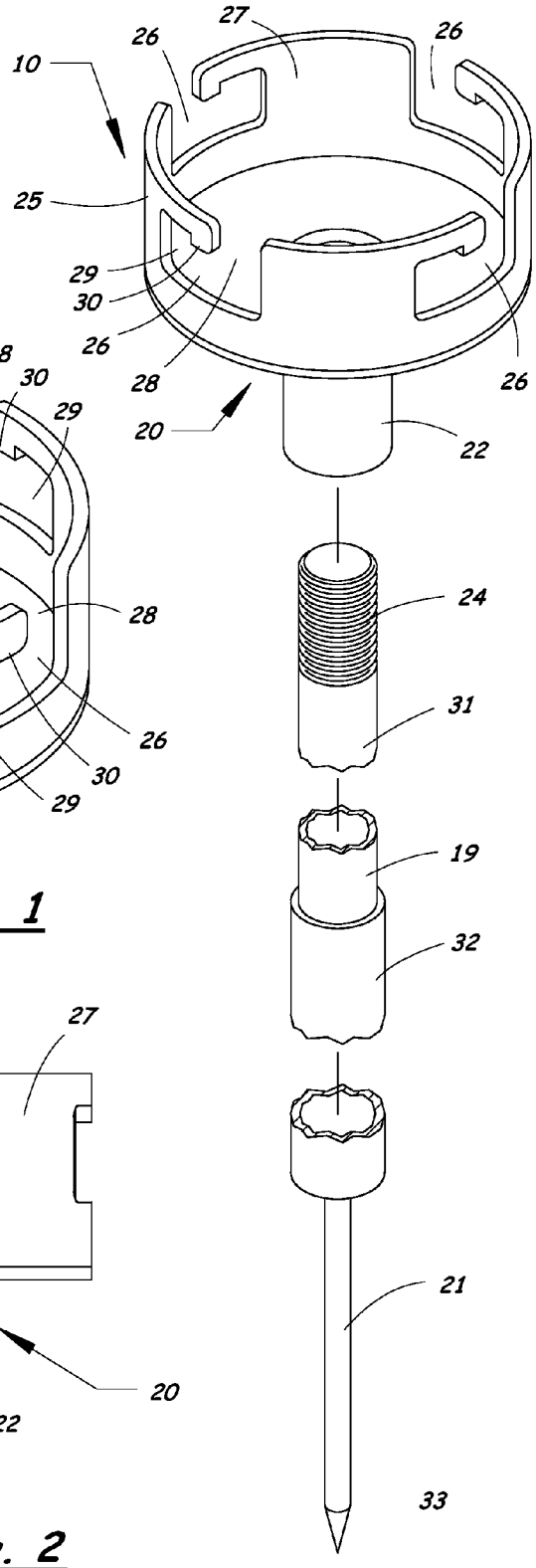
FIG. 3 is an exploded perspective view of a supplemental support assembly according to the present invention.
Figure 4:
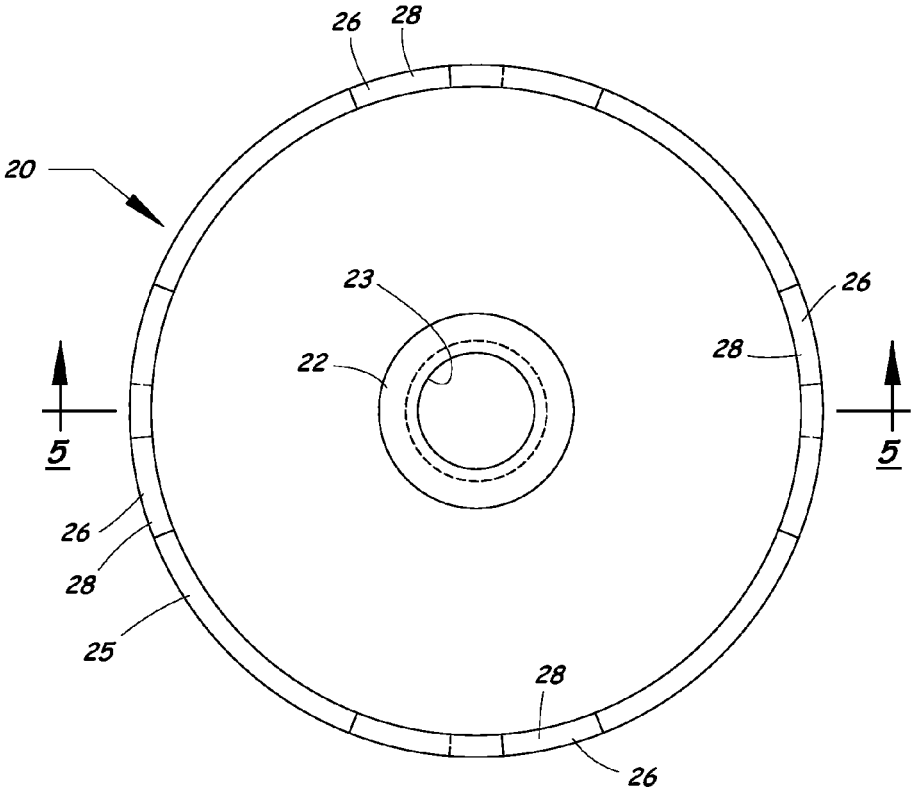
FIG. 4 is a plan view of the coupler shown in FIG. 1.
Figure 5:
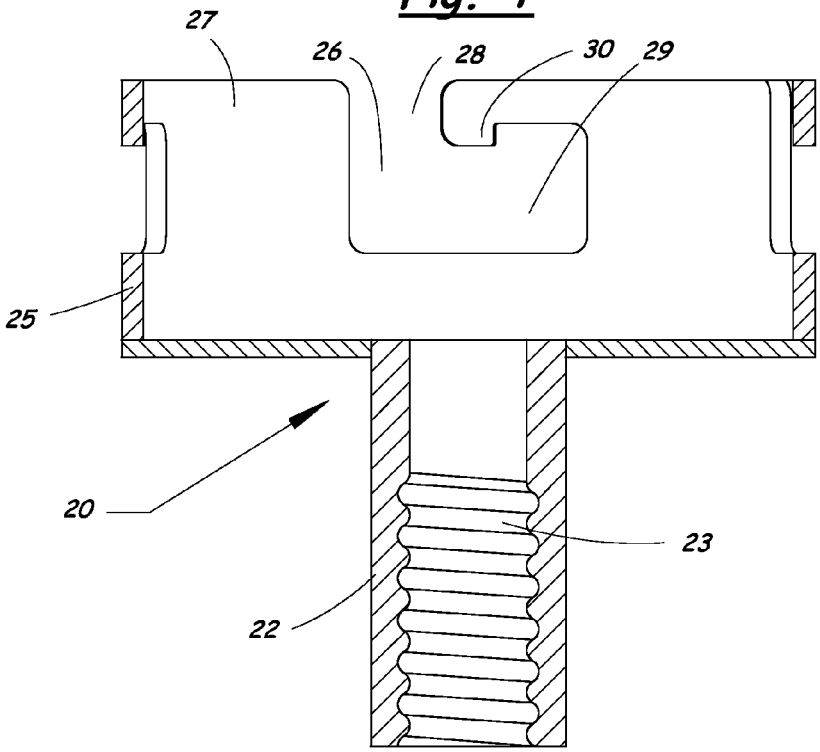
FIG. 5 is a cross section elevation view of the coupler shown in FIG. 1.

The structural details of the coupler 20 are illustrated in FIGS. 1 to 5. As illustrated in FIG. 3, the coupler 20 is removably connected to the pole 19 by a threaded connection. Specifically, the coupler 20 has a first portion 22 with female threads 23 at its lower end for connecting to corresponding male threads 24 at the top of the pole 19.

The coupler 20 has a second portion 25 at its upper end for connecting to the framework 15 of the collapsible shelter structure 11. The second portion 25 of the coupler 20 has a generally cylindrical structure with a plurality of slots 26 formed in a sidewall 27 thereof. The slots 26 are generally L-shaped to allow locking engagement with the framework 15 of the collapsible shelter structure 11 by a combination of axial movement and rotational movement of the coupler 20 relative to the framework 15. Each of the slots 26 are arranged to receive a respective one of the spokes 17 of the framework 15.

Figure 6:
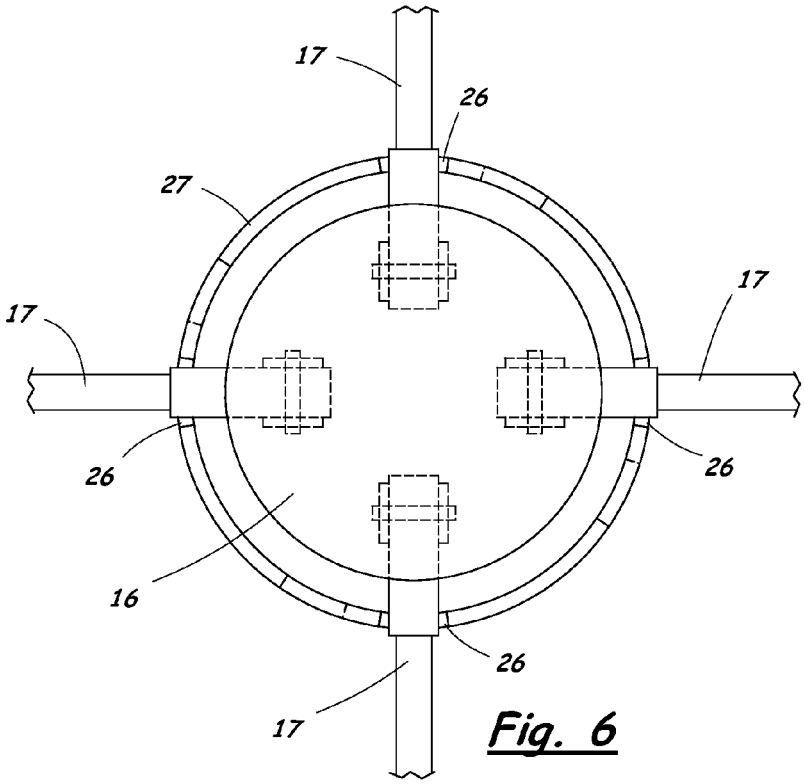
FIG. 6 is a plan view of the support assembly of the present invention after being pushed over a central hub with spokes of a collapsible shelter structure.
Figure 7:
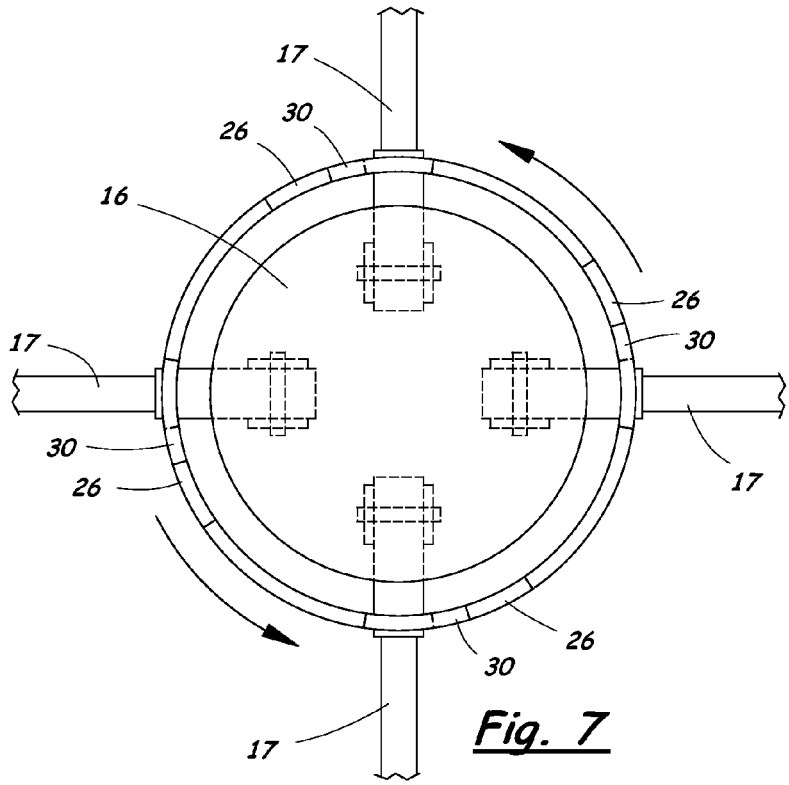
FIG. 7 is another plan view of the support assembly of the present invention after being rotated into locking engagement with the central hub and spokes.

Each of the slots 26 have an axial portion 28 open at the top of the coupler 20 and a circumferential portion 29 extending circumferentially from the axial portion 28. As illustrated in FIG. 6, the axial portions 28 of the slots 26 are arranged to allow the coupler 20 to be pushed over the central hub 16 of the framework 15 of the shelter structure 11 with the coupler 20 surrounding the central hub 16 and the spokes 17 of the framework 15 extending radially outwardly through the slots 26. The circumferential portions 29 of the slots 26 are arranged to allow the coupler 20 to be rotated about a longitudinal axis of the pole 19 into locking engagement with the spokes 17, as illustrated in FIG. 7.

A lip 30 extends into at least one, and preferably all, of the slots 26 to resist rotational movement of the coupler 20 in a direction that would tend to uncouple the coupler 20 from the framework 15. As illustrated in FIGS. 1 to 3, the lips 30 extend only partway into the circumferential portion 29 of each of the slots 26 so that the spokes 17 can still pass between the lip 30 and the bottom of the slots 26 when the coupler 20 is slightly raised relative to the framework 15. This construction of the slots 26 provides a quick and reliable connection between the coupler 20 and the framework 15, while also allowing a quick and easy uncoupling from the framework 15.

The pole 19 is a telescoping pole assembly that can be adjusted in length between a compact storage position and an extended support position. For example, the telescoping pole assembly can be of the type having two pole sections 31, 32 that are nested one within the other, and a locking structure for locking the pole sections 31, 32 together in a known manner.

The ground engaging structure 21 at the bottom end of the pole 19 comprises a spike 21 with a pointed end 33 for penetrating the ground G, as illustrated in FIGS. 3 and 9. The spike 21 can be pressed into the ground G to help secure the supplemental support assembly 10 in place. For example, the spike 21 will prevent side-to-side movement of the lower end of the pole 19 and will resist raising from the ground G (e.g., when a gust of wind blows through the shelter structure 11 that raises the roof).

The structural details of the supplemental support assembly 10 of the present invention are described above. A method of using the supplemental support assembly 10 will now be described.

The support assembly 10 can be used to supplement the primary support assembly of a collapsible shelter structure 11 to prevent the shelter structure 11 from collapsing under heavy external loads. While the primary support assembly is connected to the outer ends of the spokes 17 supporting the roof of the shelter structure 11, the supplemental support assembly 10 of the present invention is coupled with and supports a center portion of the framework 15 supporting the roof.

The coupler 20 of the support assembly 10 is coupled with the center portion of the framework 15 by a combination of axial movement and rotational movement of the coupler 20 relative to the framework 15 to engage the spokes 17 into the L-shaped slots 26. The length of the pole 19 can then be adjusted to allow the pointed lower end 21 to penetrate the ground to secure the support assembly 10 in place and to adapt the pole 19 to the height of the shelter structure 11.

While the invention has been specifically described in connection with specific embodiments thereof, it is to be understood that this is by way of illustration and not of limitation, and the scope of the application should be construed as broadly as the prior art will permit.

What is claimed is:

1. A collapsible shelter structure, comprising:

a flexible fabric cover having a plurality of side walls and a top;

a self-supporting framework comprising a central hub and a plurality of resilient spokes hingedly connected to said central hub and radiating outwardly therefrom for engaging and self-supporting the top of the fabric cover to provide a clear span roof for the shelter structure; and a supplemental support assembly for temporarily supporting said framework, said supplemental support assembly comprising a pole having a coupler at one end for coupling with and uncoupling from said framework, and a ground engaging structure at the other end of the pole for engaging the ground, whereby said supplemental support assembly supports a center portion of said framework to prevent the clear span roof of the shelter structure from collapsing under heavy external loads;

wherein said coupler comprises a plurality of slots for coupling with said framework, each of said slots being arranged to receive a respective one of said spokes;

wherein said coupler surrounds said central hub with said spokes extending radially outwardly through said slots;

wherein said slots each have an axial portion open at the top of the coupler and a circumferential portion that extends circumferentially from the axial portion; and wherein said axial portions of the slots are arranged to allow the coupler to be pushed over the central hub with the spokes extending through the slots, and said circumferential portions of the slots are arranged to allow said coupler to be rotated into locking engagement with said spokes.

2. The collapsible shelter structure according to claim 1, wherein said plurality of spokes comprise four resilient spokes hingedly connected to said central hub.

3. The collapsible shelter structure according to claim 1, further comprising a lip extending into at least one of said slots to resist rotational movement of the coupler in a direction that would tend to uncouple the coupler from said framework.

4. The collapsible shelter structure according to claim 1, wherein said pole comprises a telescoping pole assembly that can be adjusted in length between a compact storage position and an extended support position.

5. The collapsible shelter structure according to claim 1, wherein said ground engaging structure of said pole comprises a spike with a pointed end for penetrating the ground.

6. The collapsible shelter structure according to claim 1, wherein said coupler is removably connected to said pole by a threaded connection.

7. A collapsible shelter structure, comprising:

a flexible fabric cover having a plurality of side walls and a top;

a self-supporting framework comprising a central hub and a plurality of resilient spokes hingedly connected to said central hub and radiating outwardly therefrom for engaging and self-supporting the top of the fabric cover to provide a clear span roof for the shelter structure; and a supplemental support assembly for temporarily supporting said framework, said supplemental support assembly comprising a pole having a coupler at one end for coupling with and uncoupling from said framework, and a ground engaging structure at the other end of the pole for engaging the ground, whereby said supplemental support assembly supports a center portion of said framework to prevent the clear span roof of the shelter structure from collapsing under heavy external loads;

wherein said coupler comprises a plurality of slots for coupling with said framework, and wherein said slots are generally L-shaped to allow locking engagement with said framework by a combination of axial and rotational movement of the coupler relative to the framework.

8. In combination, a collapsible shelter structure and a supplemental support assembly for supporting the collapsible shelter structure, the shelter structure comprising:

a self-supporting framework having a central hub and a plurality of resilient spokes hingedly connected to the central hub and radiating outwardly therefrom for engaging and self-supporting a fabric cover to provide a clear span roof for the shelter structure, and said supplemental support assembly comprising:

a pole having first and second ends;

a coupler connected to said first end of said pole for coupling with the framework of the collapsible shelter structure, said coupler comprising a generally cylindrical structure with a plurality of slots formed in a sidewall thereof, each of said slots having an axial portion open at one end of the coupler and a circumferential portion that extends circumferentially from said axial portion, whereby said axial portions of the slots are arranged to allow the coupler to be pushed over the central hub with the spokes passing through the slots, and said circumferential portions of the slots are arranged to allow the coupler to be rotated into locking engagement with the spokes; and a ground engaging structure provided at said second end of said pole.

9. The combination according to claim 8, further comprising a lip extending into the circumferential portion of at least one of said slots to resist rotational movement of the coupler in a direction that would tend to uncouple the coupler from the framework.

10. The combination according to claim 8, wherein said pole comprises a telescoping pole assembly that can be adjusted in length between a compact storage position and an extended support position.

11. The combination according to claim 8, wherein said ground engaging structure of said pole comprises a spike with a pointed end for penetrating the ground.

12. The combination according to claim 8, wherein said coupler is removably connected to said pole by a threaded connection.

13. The combination according to claim 8, wherein each of said slots are generally L-shaped to allow locking engagement with a framework by a combination of axial and rotational movement of the coupler relative to the framework.

14. A method of providing supplemental support for a collapsible shelter structure, comprising:

providing a shelter structure comprising a self-supporting framework having a central hub and a plurality of resilient spokes hingedly connected to the central hub and radiating outwardly therefrom for engaging and self-supporting a fabric cover to provide a clear span roof for the shelter structure;

providing a supplemental support assembly having a pole with first and second ends, a coupler at said first end, and a ground engaging structure at said second end;

coupling said coupler with a center portion of the framework supporting the clear span roof of the collapsible shelter structure; and placing said ground engaging structure into engagement with the ground surface under said center portion;

wherein said coupler comprises a generally cylindrical structure with a plurality of L-shaped slots formed in a sidewall thereof, and wherein said coupler is coupled with the center portion of the framework by a combination of axial and rotational movement of the coupler relative to the framework.

15. The method according to claim 14, further comprising adjusting a length of said pole using a telescoping assembly to adapt said pole to a height of said collapsible shelter structure.

16. The method according to claim 14, wherein said ground engaging structure comprises a pointed end, and further comprising penetrating the ground surface with said pointed end to help secure the supplemental support assembly in place.

* * * * *